United States Patent [19]

Sessink

[11] 4,348,102

[45] Sep. 7, 1982

[54] ELECTROGRAPHIC APPARATUS WITH CONTROL SYSTEM FOR FIXING POWDER IMAGES BY HEAT AND CONTACT

[75] Inventor: Bernardus W. L. M. Sessink, Venlo, Netherlands

[73] Assignee: Óce-Nederland B.V., Venlo, Netherlands

[21] Appl. No.: 246,134

[22] Filed: Mar. 19, 1981

[30] Foreign Application Priority Data

Apr. 9, 1980 [NL] Netherlands ..... 8002065

[51] Int. Cl.[3] ..... G03G 15/00; G03G 15/22

[52] U.S. Cl. ..... 355/14 SH; 355/3 SH; 355/3 FU; 355/14 FU; 432/4; 432/11; 432/35; 432/60; 219/216

[58] Field of Search ..... 355/14 R, 3 R, 14 FU, 355/3 FU, 14 TR, 3 TR, 30, 14 SH, 3 SH; 430/130; 432/4, 10, 11, 12, 34, 35, 60; 219/216, 499

[56] References Cited

U.S. PATENT DOCUMENTS

| | | | |
|---|---|---|---|
| 3,794,417 | 2/1974 | Machmer | 355/14 FU X |
| 3,861,863 | 1/1975 | Kudsi | 432/60 |
| 3,916,256 | 10/1975 | Kotani | 219/216 X |
| 3,960,446 | 6/1976 | Ogawa et al. | 355/14 SH X |
| 4,049,947 | 9/1977 | Bestenreiner et al. | 219/216 |
| 4,056,822 | 11/1977 | Thornburg et al. | 219/216 X |
| 4,078,166 | 3/1978 | Kitamura et al. | 219/216 |
| 4,132,882 | 1/1979 | Endo et al. | 219/216 |

*Primary Examiner*—Arthur C. Prescott
*Attorney, Agent, or Firm*—Albert C. Johnston

[57] ABSTRACT

An electrographic apparatus by which powder images corresponding to electrostatic images can be formed on receiving material and fixed onto the receiving material by heat and contact is provided with a control system which regulates the quantity of receiving material transported to the fixing device per unit of time so as to keep the heat content of heated surface elements of the fixing device suited for the heat capacity of the receiving material even when receiving materials of different weights are used. The control system can also make the formation of either electrostatic or powder images dependent upon the existance of heat content in the fixing device suited for the heat capacity of the receiving material. In an apparatus employing sheets as the receiving material and providing fixed time intervals for consecutive formations of electrostatic or powder images and for transport of sheets to receive the respective powder images, the control system can respond to a deficiency of heat content in the fixing device by causing one or a certain plurality of the fixed time intervals to lapse without image formation and sheet transport after each occurrence of one or a certain plurality of the time intervals with image formation and sheet transport.

4 Claims, 8 Drawing Figures

ELECTROGRAPHIC APPARATUS WITH CONTROL SYSTEM FOR FIXING POWDER IMAGES BY HEAT AND CONTACT

This invention relates to an electrographic apparatus by which powder images corresponding to electrostatic images can be formed on receiving material, and which is provided with means for transporting receiving material to an image fixing zone and with a heat contact fixing device comprising moving heated surface means for contacting a powder image and a receiving material moving into the fixing zone so that the powder image is fixed onto the receiving material by heat and contact.

An apparatus of the type referred to is disclosed, for instance, in U.S. Pat. No. 4,183,658. According to that disclosure, an electrophotographic copying apparatus is provided in which an electrostatic charge image is formed on an endless photoconductive belt and then is developed on this belt to form a powder image. The powder image then is transferred onto a heated intermediate belt and subsequently is transferred and simultaneously fixed onto a heated sheet of receiving paper in a contact fixing zone. The receiving paper is heated while being moved to the fixing zone by surface contact with a circulating belt to which heat is supplied by a heating element. Heat is similarly supplied to the intermediate belt by a heating element. The intermediate belt and the circulating belt each possess a certain heat capacity and, depending upon the temperature, a certain heat content. Some of their heat content is transferred to the receiving paper as it is being moved into the fixing zone, thus heating the paper, and as a result the belts cool down.

The degree of cooling thus caused depends on the quantity of heat transferred to the receiving paper, and this in turn depends on the heat capacity of the receiving paper. Generally a paper having a higher base weight will exhibit a greater heat capacity, so a lesser temperature rise as a result of being supplied a certain quantity of heat, then will a paper having a lower base weight. In order to obtain proper fixing of the transferred powder image on the receiving paper, the temperature of the receiving paper should be within relatively closely established limits. At temperatures either below the lower or above the upper of these limits undesirable effects occur, such as incomplete fixing or an image separation by which a portion of the image to be transferred remains adherent to the intermediate belt.

In the use of conventional plain-paper copying machines, papers of a very wide variety are employed as receiving material, their base weights ranging from about 40 g/m$^2$ to beyond 200 g/m$^2$. The known heat contact fixing devices are not directly suitable for uniformly processing such a variety of papers. If the heat source of the fixing device is set to heat a receiving paper weighing 40 g/m$^2$ the heat available for image fixing will be exhausted so rapidly that the heavier receiving paper will not be brought to the correct temperature. On the other hand, if the heat source is set for heating receiving paper of 200 g/m$^2$ to the desired temperature as it is moved into the fixing zone, then receiving paper of 40 g/m$^2$ will be heated to much too high a temperature. Consequently, the heat sources of such fixing devices are usually set so that they will bring a widely used type of paper, such as paper weighing 80 g/m$^2$, to the correct temperature. In this practice, as a result of the marginal temperature setting, tolerances are provided for base weights varying both downward and upward from the norm. In actual practice the tolerance downward is generally sufficient, while the upward tolerance is not great enough.

The principal object of the present invention is to provide an electrographic apparatus by which image receiving materials having different heat capacities can be processed satisfactorily, and even when mixed with one another, with avoidance of the shortcomings mentioned above.

In accordance with this invention, in an electrographic apparatus including means for transporting receiving material to an image fixing zone and a heat contact fixing device comprising moving heated surface means for contacting a powder image and a receiving material moving into the fixing zone so that the powder image is fixed onto the receiving material by heat and contact, the apparatus is provided with a control system comprising a first signalling means for issuing a first signal representing the heat content of the contact heating means, a second signalling means for issuing a second signal representing the heat capacity of the receiving material, and means responsive to the said first and second signals for controlling the amount of receiving material transported per unit of time by the material transporting means as a function of the heat content of the heated surface means and of the heat capacity of the receiving material.

This system permits several types of receiving material to be used for satisfactory fixing of the powder images formed by the electrographic apparatus, even when the different materials are mixed as in a stack from which sheets are to be fed to the fixing device. The invention enables each type of the receiving material to be heated reliably to the temperature correctly suited for fixing the powder images onto the material.

According to a preferred embodiment of the invention, in an electrographic apparatus in which sheet-like receiving material is employed, the control system functions by controlling the number of sheets of receiving material transported per unit of time. For this purpose the system comprises means for issuing a third signal to cause each occasion of the formation of an image that will exist to be processed in the apparatus, i.e., either an electrostatic image or the corresponding powder image; the means for transporting the receiving material is rendered operative by this third signal to transport a sheet of receiving material for receiving the powder image ensuing from the issue of the third signal; and the means for controlling the amount of receiving material transported includes means activated by the first and second signals for controlling the number of third signals to be issued per unit of time as a function of the heat content of the heated surface means of the fixing device and of the heat capacity of the receiving material.

In cases where the electrostatic images are formed directly on the receiving material, such as for example in copying machines which function in accordance with the direct electrophotographic process, this preferred system ensures that each powder image formed will also be properly fixed, thus avoiding the production of unsatisfactory copies and waste of the receiving material.

In cases where at least one image transfer takes place before the powder image is formed on the receiving material, such as for example in copying machines which function in accordance with the indirect electrophotographic process, this system ensures that the medium on which the electrostatic image is formed, and possibly a device for cleaning the imaging medium, are not unnecessarily subjected to electrical and mechanical stresses when the fixing conditions are not properly suited for fixing the powder image on the receiving material.

The above mentioned and other objects, features and advantages of the invention will be further evident from the following description and the accompanying drawings of illustrative embodiments of the invention. In the drawings:

FIG. 1 is a schematic diagram of functional components of an electrographic apparatus;

FIG. 2 schematically illustrates a heat contact fixing device in accordance with the invention in an electrographic apparatus having components as indicated in FIG. 1;

Figure 1:
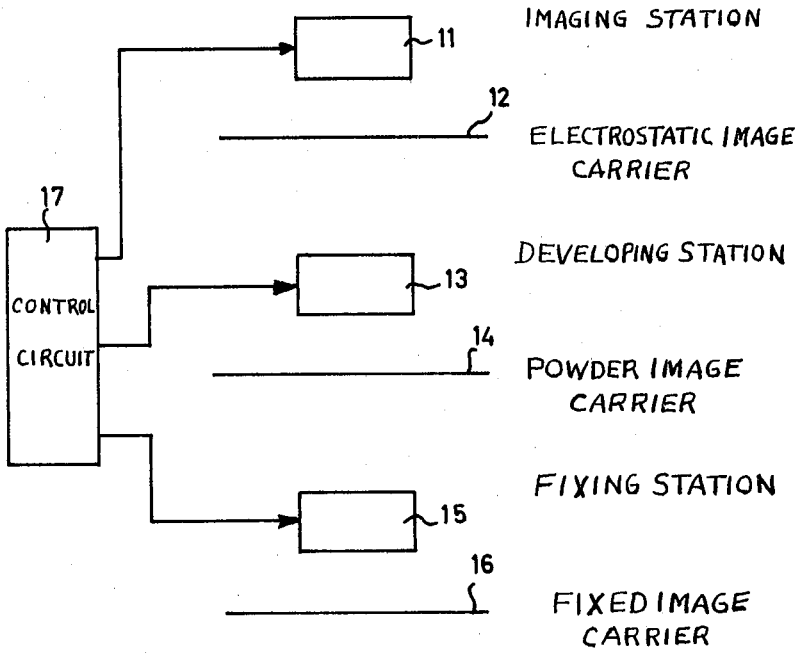

FIG. 1 shows schematically the basic functional components of an electrographic apparatus. Such an apparatus comprises at least one image forming station 11, in which an electrostatic charge image is formed on a substrate 12; a developing station 13 in which an electrostatic charge image on a substrate 14 is developed to give a visible powder image; and a fixing station 15 in which a powder image is fixed on a substrate 16. The substrates, or image carriers, 12, 14 and 16 can be one and the same for all three stages of the operations, or can be different for each stage or for any two of the stages. A more detailed description of various electrographic processes employing substrates which differ or do not differ from each other is given in the book by R. M. Schaffert, "Electrophotography" (Focal Press, 1975), to which reference is made.

A control circuit 17 is connected with the various processing stations mentioned for coordinating their operations. Among suitable control circuits are, for example, those described in U.S. Pat. Nos. 3,912,390 and 4,252,432, the disclosures of which are incorporated herein by reference.

Figure 2:
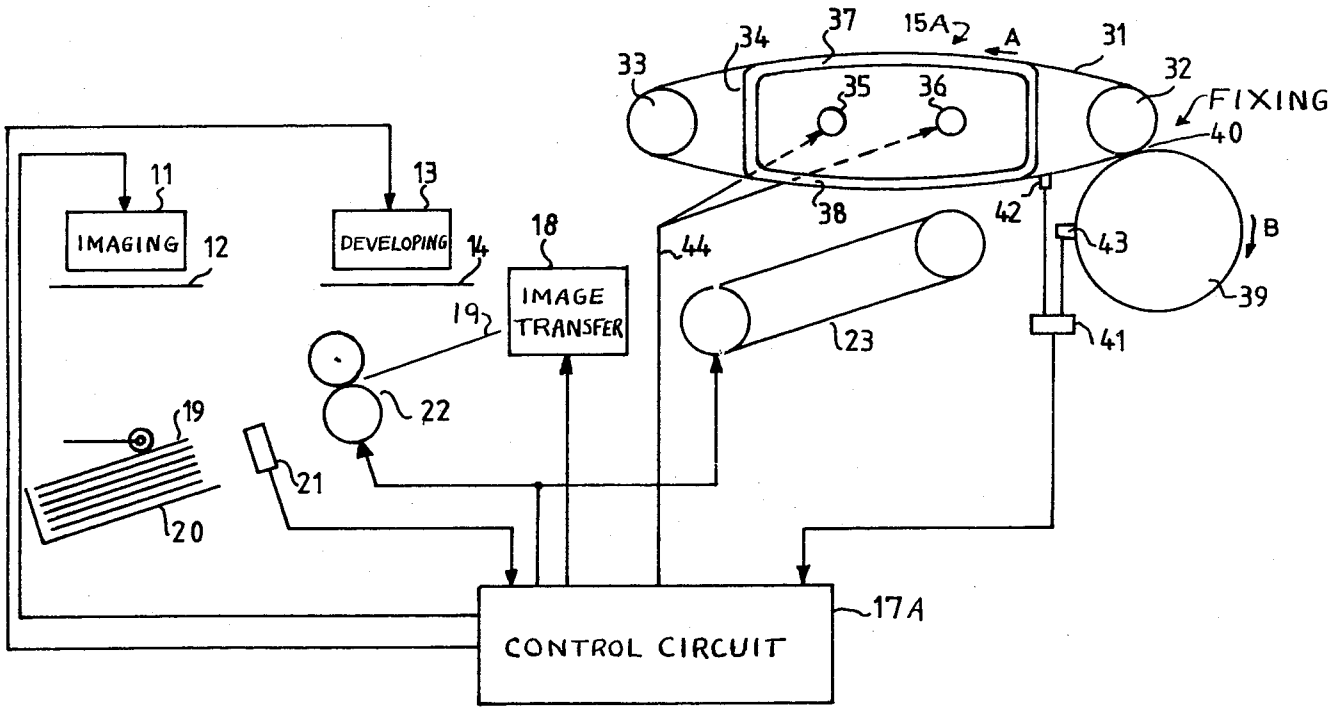

FIG. 2 illustrates an example of a heat contact fixing device suitable for use at the fixing station 15 of an electrographic copying apparatus provided with a control system in accordance with the present invention. FIG. 2 also indicates schematically other components that may be present in such an apparatus. By way of example, it is indicated that a powder image from a substrate 14 can be transferred in a transfer station 18 to a substrate in the form of a sheet 19 of receiving material which is fed from a stack of sheets 19 held in a stock tray 20. As further indicated in FIG. 2, the control system of the apparatus includes a control circuit 17A, and a first signalling means 21 connected with this circuit is provided for sensing and for issuing a first signal representing the heat capacity of each sheet 19 of the receiving material as the sheet is being fed from the tray 20. Various devices suitable for use as the first signalling means are described more particularly hereinbelow.

A sheet 19 to receive an image is transported to the transfer station 18 by a suitable first transport means, such as sheet feeding rollers 22. After a powder image is transferred at the transfer station, the sheet 19, which now carries the powder image in unfixed state, is transported onward by a second transport means, for instance an endless belt 23, which conveys the imaged sheet 19 into a fixing zone at the nip 40 of the heat contact fixing device 15A.

The heat contact fixing device 15A comprises a circulating belt 31 which is tensioned over two rollers 32 and 33 and over a metal casing 34. Two infrared elements 35 and 36 are provided inside the casing 34, by means of which the casing walls 37 and 38 and through them the belt 31 can be heated. Such a device is described inter alia more particularly in United States patent application Ser. No. 954,580 filed Dec. 30, 1979, and now abandoned, the disclosure of which is incorporated herein by reference. A backing roller 39 adjacent to a portion of the belt 31 at roller 32 forms the nip 40, or contact fixing zone, in which the powder image on a sheet 19 fed to the fixing device by the second transport means 23 is fixed to the sheet. The surface of the backing roller 39 becomes heated by heat transfer from the belt 31, thus being part of the heated contact means of the fixing device.

The belt 31 and the backing roller 39 are connected with suitable drive means (not shown) by which they are driven in the directions of the arrows A and B, respectively. In the nip 40 the powder image on a sheet 19 is brought into contact with the heated belt 31. Meanwhile the back of the sheet 19 moving into the fixing zone at the nip 40 is contacted by the heated surface of the backing roller 39. The powder image on the sheet 19 softens at a correctly selected temperature of the belt 31, and the softened powder image adheres to the sheet 19. Thus, as the sheet emerges from the nip 40 it is provided with a fixed powder image.

A second signalling means 41 is connected with the control circuit 17A and issues to the control circuit a signal representing the heat content of the heated surface means of the fixing device. The second signalling means 41 is shown as comprising for this purpose two temperature detectors 42 and 43 for sensing the respective temperatures of the belt 31 and backing roller 39. Depending upon the degree of accuracy desired and the heat transfer relationships existing between the components of the fixing device 15A, the signalling means 41 can comprise a varying number of temperature sensors, with or without detectors which provide information regarding other parameters that influence the heat balance of the fixing device 15A. In actual practice one or two temperature sensors will suffice.

The drive of belt 31 and of backing roller 39 and the supply of energy to the heating elements 35 and 36 are controlled by the control circuit 17A. The heating elements are connected with the control circuit as indicated schematically by the line 44 in FIG. 2.

Figure 3:
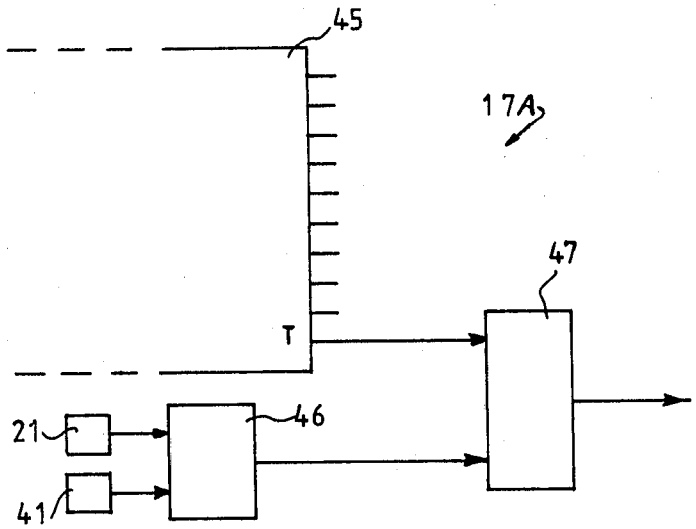
FIG. 3 is a diagram of parts of a control system according to the invention for an apparatus such as that of FIG. 1 or FIG. 2.

FIG. 3 shows schematically an arrangement of a control circuit 17A suitable for an apparatus in accordance with the invention. This control circuit comprises a combinatory circuit 45 to which input signals are fed in a known manner (not shown) and which generates control signals at a number of output gates for controlling the various processing stations of the electrographic apparatus.

While the apparatus is in operation, the combinatory circuit 45 generates at suitable points of time, at an output T, an output signal by which the transport means 22 and 23 are activated. The points of time can be determined, for example, by coupling with the drive means for the apparatus a pulse generator which supplies clock pulses for the combinatory circuit 45, as described in greater detail in U.S. Pat. No. 3,912,390. The first and second signalling means 21 and 41 are connected with a comparator circuit 46 in which the first and second signals are compared, and circuit 46 has an output connected with a first input of a circuit 47. A second input of circuit 47 is connected with the output T of the combinatory circuit 45.

The signal derived from the output T of the combinatory circuit 45 (hereinafter referred to as the T signal) can be modified in circuit 47 in accordance with the output signal from circuit 46 so that a modified T signal will appear at the output of circuit 47. Circuit 46 and circuit 47 can be either digital or analog circuits. The output signal from circuit 46 indicates to what extent the heat content of the heated surface means of the fixing device 15A is sufficient to fix properly a following powder image on a sheet 19. For this purpose the output signal from circuit 46 can exhibit two or more values. Depending upon the value of the output signal from circuit 46, the output signal from circuit 47 transmits the T signal unmodified, or else modifies the T signal in such a way that, per unit of time, less receiving material is conveyed by the transport means 22 and 23 than is the case with an unmodified T signal. The modified T signal causes a modification of either the sheet transporting speed of the transport means 22 and 23 or the number of sheets 19 transported per unit of time by the transport means 22 and 23. In either case the amount of heat extracted from the heated surface means of the fixing device 15A per unit of time by the fixing of powder images on the sheets 19 is less than is the case when the speed of transport of the sheets is unmodified or when the number of sheets 19 transported per unit of time is unmodified.

Figure 4:
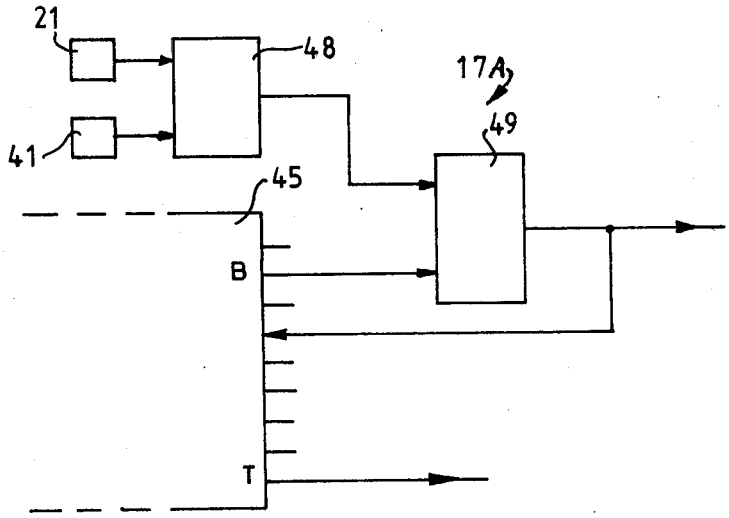
FIG. 4 is a diagram of parts of another control system for such an apparatus.

FIG. 4 illustrates a more comprehensive version of a control circuit 17A for an apparatus in accordance with the invention. In this control circuit the signalling means 21 and 41 are connected with a circuit 48 in which the first and second signals are mutually compared, and the output of the circuit 48 is connected with a first input of a circuit 49. A second input of circuit 49 is connected with an output B of the combinatory circuit 45.

The combinatory circuit 45 generates a signal at the output B (hereinafter referred to as the B signal) on each occasion and for the purpose of forming an electrostatic image in the image forming station 11 or a powder image in the developing station 13. Which of these functions is to be controlled by the B signal is not of importance for a good understanding of the invention, but it is to be noted that the effect of the invention in regard to reducing wear and contamination of the apparatus may be realized most fully when the B signal is related to a function the influence of which is felt at the earliest practicable stage in image formation.

The circuit 49 passes the B signal, or does not pass it, depending upon the value of the output signal from circuit 48. The output signal from circuit 49 fulfills the same function as the B signal, both as regards the apparatus function controlled by the B signal and with respect to certain signals which are to be generated by the combinatory circuit 45 with their generation depending upon the issue of the B signal. One of those signals is the T signal. The issue of a T signal then activates the transport means 22 and 23 to transport a sheet 19 on which the powder image, for the formation of which the appropriate B signal was generated, is to be transferred in the transfer station 18 and is to be fixed by the fixing device 15A.

Figure 5:
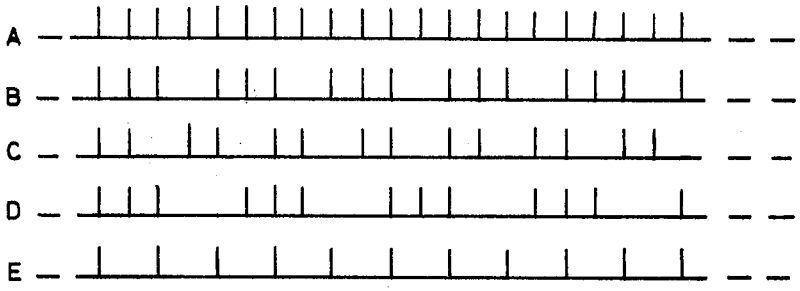
FIG. 5 illustrates by charts A, B, C, D and E various ways in which images can be formed one after another in an apparatus embodying the invention.

FIG. 5 illustrates a number of different ways in which a control circuit 17A such as that shown in FIG. 4 can influence the operation of an electrographic apparatus. The circuit 49 functions as a combinatory circuit for which the B signals serve as clock pulses, and which passes or does not pass the B signals in different ways as a function of the value of the output signal from circuit 48. At a first value of the output signal from circuit 48, which exists when the heat content of the heated surface means of the fixing device 15A is adequate to heat sheets 19 continuously up to such a high temperature that the powder images present thereon are properly fixed, the circuit 49 passes each of the B signals as denoted by the vertical lines in chart A of FIG. 5. When the heat content of the heated surface means of the fixing device is no longer sufficient, the circuit 49, as indicated in chart B, passes groups of three consecutive B signals and does not pass one B signal after each group of three.

Charts C and D of FIG. 5 represent alternative solutions for the case where the heat capacity of the sheets 19 is even greater in relation to the heat content of the heated surface means of the fixing device 15A. According to chart C, two B signals are passed and one is not passed; according to chart D, three B signals are passed and two are not passed. If the heat capacity of the sheets 19 is greater even more relative to the heat content of the heated surface means, then the solution shown in chart E of FIG. 5 can be selected, where consecutive B signals are alternately passed and not passed by the circuit 49.

It has been found that the number of types of receiving material which can be used for satisfactory fixing of the powder images with a given rate of heat input to the fixing device 15A can be increased considerably by employing a combination of the control circuit functions represented by the charts A and E of FIG. 5. In such a case, the function of the circuit 49 is implemented with the aid of a single, switchable flip-flop and of a threshold circuit by which the flip-flop is connected or disconnected depending upon whether the output signal from circuit 48 exceeds or does not exceed a threshold value.

Figure 6:
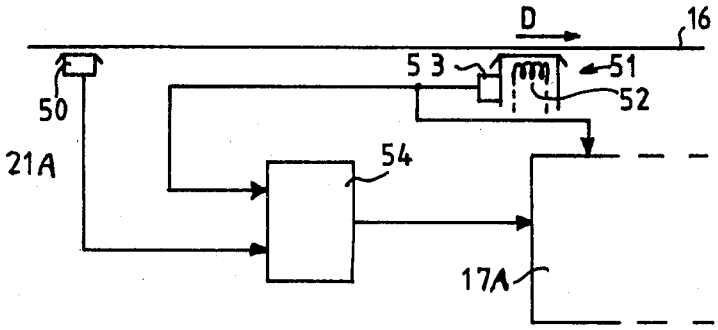
FIG. 6 illustrates a means for obtaining a signal corresponding to the heat capacity of the receiving material.
Figure 7:
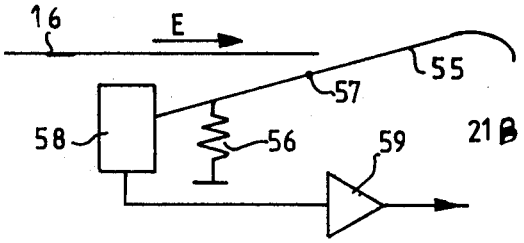
FIG. 7 illustrates another means for obtaining a signal corresponding to the heat capacity of the receiving material.
Figure 8:
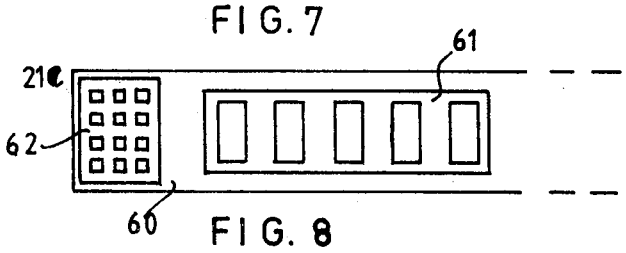
FIG. 8 illustrates a third means for obtaining a signal corresponding to the heat capacity of the receiving material.

FIGS. 6, 7 and 8 illustrate three different devices which are suitable for use as the first signalling means 21 of a control system according to the invention.

FIG. 6 illustrates a receiving material 16 which is being fed past a first signalling means 21A in the direction of the arrow D. The first signalling means 21A comprises a first temperature sensor 50 which measures the temperature of the receiving material 16. Further along the path of the receiving material an element 51 is installed which is provided with a heating coil 52 and with a temperature sensor 53 that measures the temperature of the element 51. The temperature sensors 50 and 53 are connected with a comparison circuit 54 which, in the manner described below, emits an output signal corresponding to the heat capacity of the receiving material 16.

The operation of the signalling means 21A is as follows: Before the receiving material 16 is present at the element 51 the heating coil 52 supplies a quantity of heat to element 51 and the resulting temperature of this element is measured by the temperature sensor 53. The heat supply via the heating coil 52 is stopped as soon as the heat content of the element 51 has reached a predetermined value corresponding to a certain temperature measured by the sensor 53. That temperature is higher than the temperature of the receiving material 16. Subsequently the receiving material 16 is transported past the element 51, whereupon the temperature of the element 51 drops as a result of heat transfer from element 51 to the cooler receiving material 16. When the element 51 has been in contact with the receiving material 16 for a fixed period of time $\Delta t$ determined by the control circuit 17 or 17A, the temperature of the element 51 is again measured by the temperature sensor 53. The temperature drop of element 51 as thus determined is proportional to the heat capacity of the receiving material 16. The temperature sensor 50 meanwhile issues a signal to circuit 54, by means of which the influence of the intrinsic temperature of the receiving material 16 is compensated for so that the output signal from circuit 54 corresponds with the heat capacity of the receiving material 16.

A second method of determining the heat capacity can also be employed with the signalling means 21A described above. In this method, taking as a basis the starting conditions described above, a determination is obtained of the time interval which is required for a certain temperature drop to occur in element 51 as a result of contact with the receiving material 16. The heat capacity of the receiving material 16 is then inversely proportional to this interval of time. Here too the temperature sensor 50 and the circuit 54 serve to compensate for the intrinsic temperature of the receiving material 16.

FIG. 7 illustrates a signalling means 21B by which a signal corresponding to the heat capacity of a receiving material 16 can be established indirectly. Here the basic premise is that a more or less fixed relationship exists between the heat capacity and the base weight of the receiving material. The signalling means 21B comprises a resiliently displaceable element 55 which is rotatable about an axis against the tension of a spring 56. The receiving material 16 can be fed against the element 55 in the direction of the arrow E, which then is turned about the axis 57 against the spring tension. The degree of turning movement is proportional to the weight and hence to the heat capacity of the receiving material 16, and is measured by a detector element 58. The output signal from the detector element 58 is connected with a converter 59 which converts this output signal into a form suitable for the control circuit 17A.

FIG. 8 illustrates a signalling means 21C for issuing a first signal corresponding to the heat capacity of the receiving material 16 without actually sensing properties of the receiving material. The signalling means 21C comprises an interactive operating panel 60 which forms part of a control circuit 17 or 17A that comprises a programmable digital circuit. The operating panel 60 comprises a push button panel 62 and a display unit 61 on which data and commands can be visually represented to the operator of the electrographic apparatus. By means of the operating panel 60 the operator can feed in data concerning the functioning of the apparatus, such as the base weight or the heat capacity of the receiving material to be employed, thus causing the control circuit to select correspondingly the number of sheets or the length of a certain type of receiving material to be transported to the heat contact fixing device per unit of time.

I claim:

1. In an electrographic apparatus by which powder images corresponding to electrostatic images can be formed on receiving material, and including means for transporting receiving material to an image fixing zone and a heat contact fixing device comprising moving heated surface means for contacting a powder image and a receiving material moving into said zone so that the powder image is fixed onto the receiving material by heat and contact, the improvement wherein said apparatus is provided with a control system comprising first signalling means for issuing a first signal representing the heat capacity of a receiving material provided for receiving a powder image, second signalling means for issuing a second signal representing the heat content of said heated surface means, and means responsive the said first and second signals for controlling the quantity of receiving material transported per unit of time by said transporting means as a function of the heat content of said heated surface means and of the heat capacity of said receiving material.

2. An electrographic apparatus according to claim 1, and in which the receiving material is sheet-like, said quantity controlling means being operative to vary the number of sheets of receiving material transported by said transporting means to said fixing zone per unit of time.

3. An electrographic apparatus according to claim 2, said control system comprising means for emitting third signals to cause the formation of respective images to be processed in the apparatus, said transporting means being rendered operative by each said third signal to transport a sheet of receiving material to receive the powder image ensuing from the emission of the third signal, and said quantity controlling means including means activated by said first and second signals for controlling the number of third signals emitted per unit of time as a function of the heat content of said heated surface means and of the heat capacity of the receiving material.

4. An electrographic apparatus according to claim 3, and including at least one image carrier on which the images formed are to be conveyed for processing in the apparatus, means for driving said at least one image carrier at a constant speed and circuit means for maintaining respective fixed time intervals between consecutive emissions of said third signals and between each emission of a said third signal and the related image formation, said quantity controlling means including means activated by said first and second signals when the heat content of said heated surface means is insufficient for proper fixing of a powder image onto a sheet of the receiving material for switching said circuit means into a modified state by which, during several consecutive fixed time intervals for emissions of said third signals, at one or a certain plurality of said consecutive intervals a third signal is emitted and, in alternation, at one or a certain plurality of said consecutive intervals a third signal is not emitted, whereby at each such interval when a third signal is not emitted an image formation is not caused and said transporting means is not activated to transport a sheet of receiving material to said fixing device.

* * * * *